US005713514A

United States Patent [19]

Eck

[11] Patent Number: 5,713,514

[45] Date of Patent: Feb. 3, 1998

[54] MAILBOX STAND

[76] Inventor: Wayne Eck, 10329 E. 101st St. N., Valley Center, Kans. 67147

[21] Appl. No.: 686,384

[22] Filed: Jul. 25, 1996

[51] Int. Cl.[6] ..... B65D 91/00

[52] U.S. Cl. ..... 232/39; 232/17; 248/156; 52/98

[58] Field of Search ..... 232/39, 17; 248/548, 248/156, 900; 52/296, 165, 98

[56] References Cited

U.S. PATENT DOCUMENTS

| | | | |
|---|---|---|---|
| 2,149,050 | 2/1939 | Hajicek | 232/39 |
| 2,280,476 | 4/1942 | Calvert | 232/39 X |
| 2,605,073 | 7/1952 | Buck | 232/39 |
| 3,870,262 | 3/1975 | Manning, Jr. | 232/39 X |
| 4,113,213 | 9/1978 | Gay et al. | 232/39 X |
| 4,130,239 | 12/1978 | Belsheim | 232/39 |
| 4,187,978 | 2/1980 | Dowker | 232/39 |
| 4,603,520 | 8/1986 | Deike | 52/296 X |
| 5,524,858 | 6/1996 | Friend | 232/39 X |

FOREIGN PATENT DOCUMENTS

| | | | |
|---|---|---|---|
| 1265107 | 1/1990 | Canada | 232/39 |

*Primary Examiner*—Blair Johnson

*Attorney, Agent, or Firm*—Davis & Jack, L.L.C.

[57] ABSTRACT

A mailbox stand comprising a vertical support sleeve; a vertical extension shaft rotatably and vertically adjustably mounted within and extending vertically from the upper opening of the bore of the vertical support sleeve; a support arm pivotally attached to the upper end of the vertical extension shaft; a mailbox attachment bracket fixedly attached to the support arm; a first breakaway plate fixedly attached to the lower end of the vertical support sleeve; a second breakaway plate fixedly attached to the lower surface of the first breakaway plate by means of threaded bolts; and a breakaway plate support shaft fixedly attached to and extending downward from the lower surface of the second breakaway plate.

3 Claims, 4 Drawing Sheets

MAILBOX STAND

BACKGROUND OF THE INVENTION

This invention relates generally to apparatus for supporting common rural route mailboxes which are simply and easily constructed, and which are resistant to damage through vandalism. In many parts of the United States, teenagers and young adults make a "sport" of driving at high speed along the road with windows rolled down; and upon approaching a roadside mailbox, a baseball bat or similar weapon is extended through the automobile's open window in an attempt to strike the mailbox. Such acts of vandalism typically result in destruction of the mailbox and mailbox support stand. In response to such activities, mailbox stands of heavy and bulky construction, using high strength materials have become common throughout rural America. Such mailboxes are expensive to construct, they are difficult to transport and install, and they generally are not aesthetically pleasing to the eye.

SUMMARY OF THE INVENTION

The present invention addresses the foregoing problems by incorporating a swingaway mechanism, a rotatable and extendable support shaft, and breakaway plates into a mailbox stand. Mounted in concrete at roadside is a cylindrical breakaway plate support shaft, and welded to the top of said shaft is a triangular breakaway plate. A second triangular breakaway plate is bolted to the upper surface of the lower breakaway plate, and a vertical support sleeve having a circular cross section is welded to the upper surface of the upper breakaway plate. The bolts affixing the upper breakaway plate to the lower breakaway plate are selected to have a size and tensile strength allowing the bolts to break upon application of an extreme bending force to the vertical support sleeve, rather than allowing the breakaway plate support shaft, the vertical support sleeve, or the breakaway plates to bend or deform.

A vertical extension shaft having a circular cross section is slidably positioned within the upper interior bore of the vertical support sleeve, and the vertical extension shaft is rotatably mounted in place by means of a set screw mounted within and through the wall of the vertical support sleeve. By loosening the set screw, the vertical extension shaft may be raised or lowered, adjusting the height of the mailbox; and upon correct positioning, the set screw is retightened. Upon application of extreme rotational force to the vertical extension shaft, said shaft will rotate about its vertical axis, sliding beneath said set screw.

The upper end of the vertical extension shaft is bent away from vertical approximately 45°, and a cylindrical sleeve is rotatably mounted over said upper end by means of a pair of circular collars fixedly mounted upon the vertical extension shaft, one immediately above and one immediately below the cylindrical sleeve.

A mailbox support arm is fixedly and perpendicularly attached to the exterior sidewall of the cylindrical sleeve, the support arm having a bend, causing the forward portion of the support arm to be perpendicular to the lower portion of the vertical extension shaft and parallel to the ground; the section of the support arm extending perpendicularly from the cylindrical sleeve allowing a mailbox attached to the opposite end of the support arm to swing to a position above and to the rear of the vertical extension shaft with respect to the roadway.

Fixedly attached to the support arm are mailbox attachment brackets, and attached to the mailbox attachment brackets is a common rural route mailbox.

According to the above configuration, when the mailbox is struck with extreme force by an object such as a bat or a club, the mailbox will swing upward and away to a position above and to the rear of the vertical extension shaft with respect to the roadway, rotating about the angled upper portion of the vertical extension shaft. The mailbox will also rotate in a horizontal plane about the axis of the lower portion of the vertical extension shaft, said shaft sliding beneath the set screw. Also, upon receiving such a blow, the mailbox stand breakaway bolts will fracture and the breakaway plates will detach from each other. The combination of these three effects allows the mailbox stand to topple to the ground without significant damage. Upon application of a lesser force to the mailbox, it will simply swing away to a position vertically above the vertical extension shaft and to the rear of the vertical extension shaft with respect to the road.

It is an object of the present invention to provide a mailbox stand design allowing the mailbox, upon impact, to swing upward and away rather than to break, bend or deform.

It is a further object of the present invention to provide a mailbox stand design which allows the mailbox, upon impact, to rotate about the vertical axis of its vertical support shaft rather than to break, bend or deform.

It is a further object of the present invention to provide a mailbox stand design which allows the mailbox stand, upon impact thereto, to break at a point between breakaway plates, rather than bending or deforming the stand.

It is a further object of the present invention to provide a mailbox stand which provides a means for adjustably raising or lowering the mailbox, and fixing the height of the mailbox at a desired position.

Other objects and advantages of the present invention will be apparent from the following description, the accompanying drawings, and the appended claims.

DESCRIPTION OF PRIOR ART

U.S. Pat. No. 2,605,073 issued to Buck; U.S. Pat. No. 2,280,476 issued to Calvert; U.S. Pat. No. 4,113,213 issued to Gay, et al.; U.S. Pat. No. 4,130,239 issued to Belsheim; U.S. Pat. No. 4,368,842 issued to Delange; U.S. Pat. No. 4,792,088 issued to Bonnell; and U.S. Pat. No. 5,031,828 issued to Fischer; each disclose apparatus for protectively supporting roadside mailboxes. None of the above disclosed U.S. Patents teaches the useful, novel, and inventive aspects and attributes of the present invention.

DETAILED DESCRIPTION OF THE PREFERRED EMBODIMENT

Figure 1:
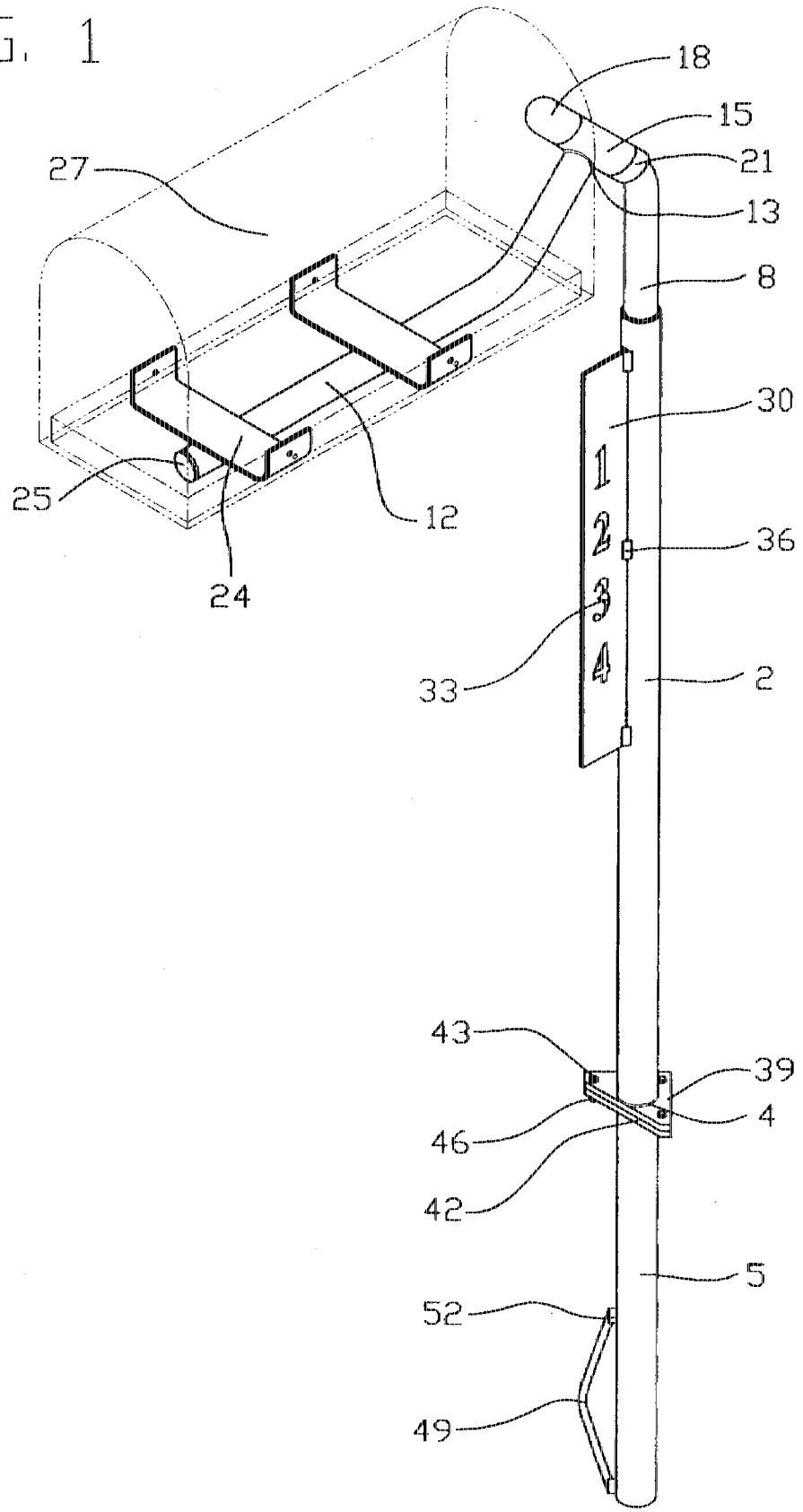
FIG. 1 is a perspective view showing generally a mailbox stand constructed in accordance with the present invention.
Figure 3:
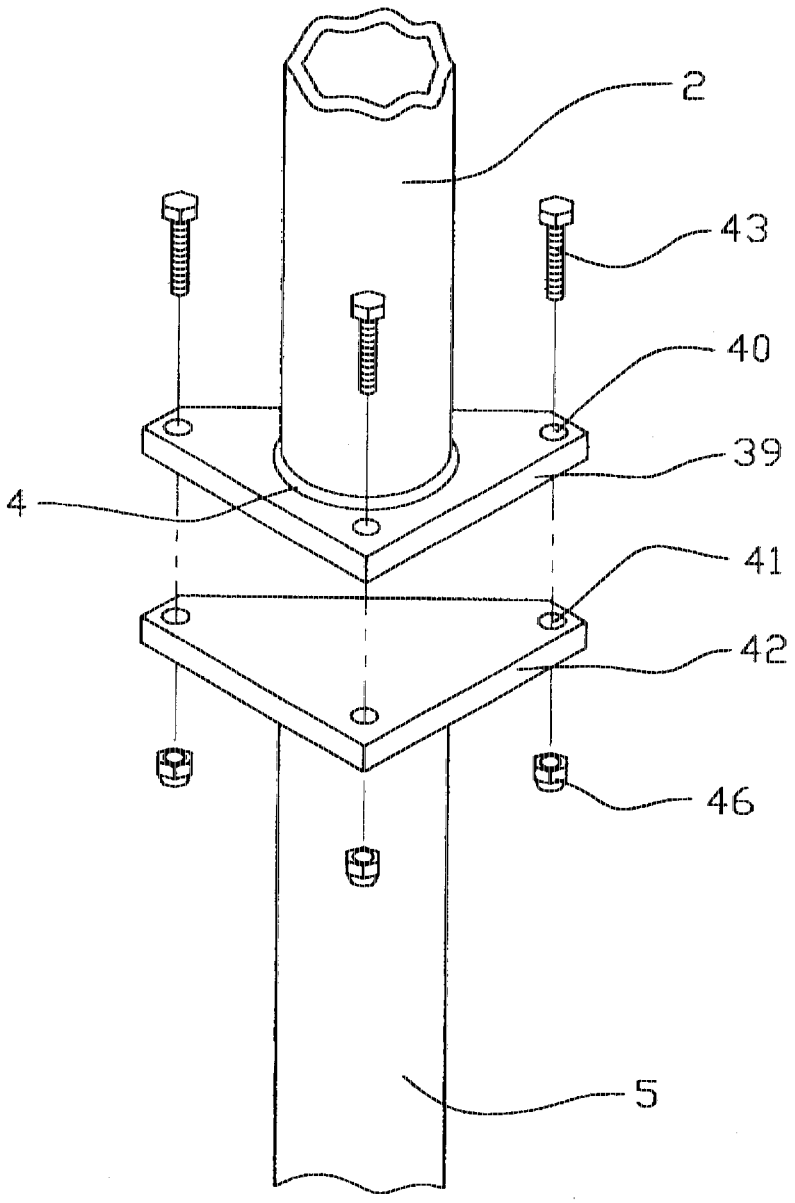
FIG. 3 is a perspective view of the breakaway plate mechanism.
Figure 4:
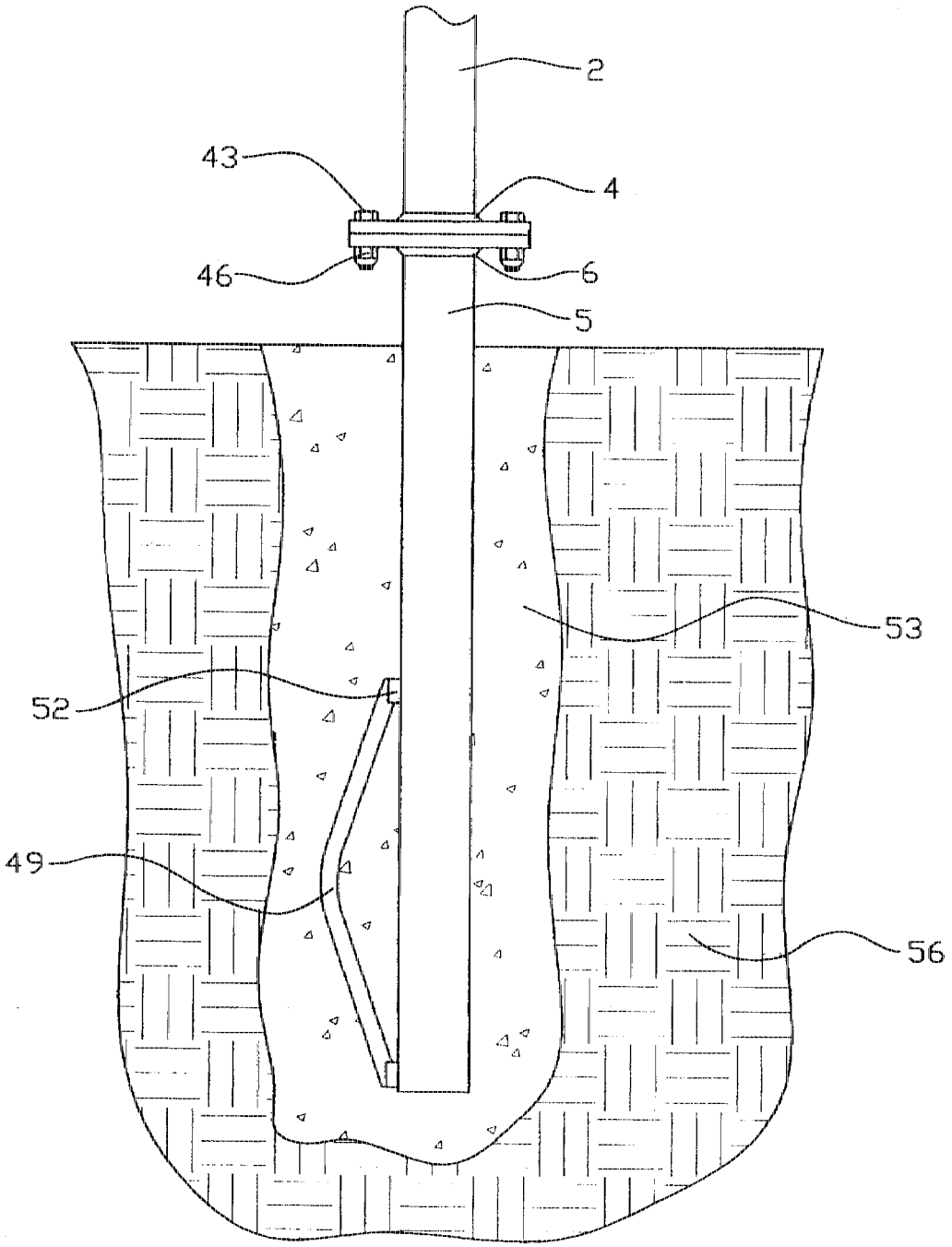
FIG. 4 is a partial view of the lower portion of the mailbox stand showing its installment in the ground, imbedded in concrete.

Referring now to the drawings and in particular to FIG. 1, a mailbox stand is shown which is constructed in accordance with the present invention. All components of the mailbox stand described below are preferably composed of steel. The breakaway plate support shaft 5 has a concrete retaining bracket 49 fixedly attached thereto by means of welds 52 at either end of the bracket. Referring to FIG. 4, the breakaway plate support shaft 5 is mounted in concrete 53, and the concrete 53 is imbedded in soil 56 beside the roadway or driveway where the mailbox stand is to be installed. A lower triangular breakaway plate 42 is fixedly attached to the upper end of the breakaway plate support shaft 5 by means of a weld 6. Referring to FIG. 3, an upper breakaway plate 39 is fixedly attached to the lower breakaway plate by means of threaded bolts 43 which extend through bolt receiving apertures 40 and 42 within and through the upper and lower breakaway plates 39 and 42. The bolts 43 are secured in place by means of self-locking nuts 46. The upper and lower breakaway plates 39 and 42 are preferably triangular in shape, with a flat side of the triangle facing toward the roadway. Such orientation of the triangle assures that, upon application of force to the mailbox stand, the mailbox stand acts as a lever arm turning about a fulcrum consisting of two of threaded bolts 43 and transferring the force to the single third threaded bolt.

Referring again to FIG. 1, a vertical support sleeve 2 having a circular cross section is fixedly attached to the upper surface of the upper breakaway plate 39 by means of a weld 4. Referring to FIG. 4, the bolts 43 are selected according to their tensile strength so that upon application of a side-on striking force to the vertical support sleeve 2, neither the vertical support sleeve 2, the upper breakaway plate 39, the lower breakaway plate 42, nor the breakaway plate support shaft 5, will bend or deform; and instead, the bolts 43 will break. The bolts 43 should also be of sufficient strength to stand up to the ordinary forces involved in normal usage and exposure to windstorms. Upon breakage of the mailbox stand at the breakaway plate point, the mailbox stand is easily and inexpensively restored to useful condition by reinstalling replacement bolts.

Figure 2:
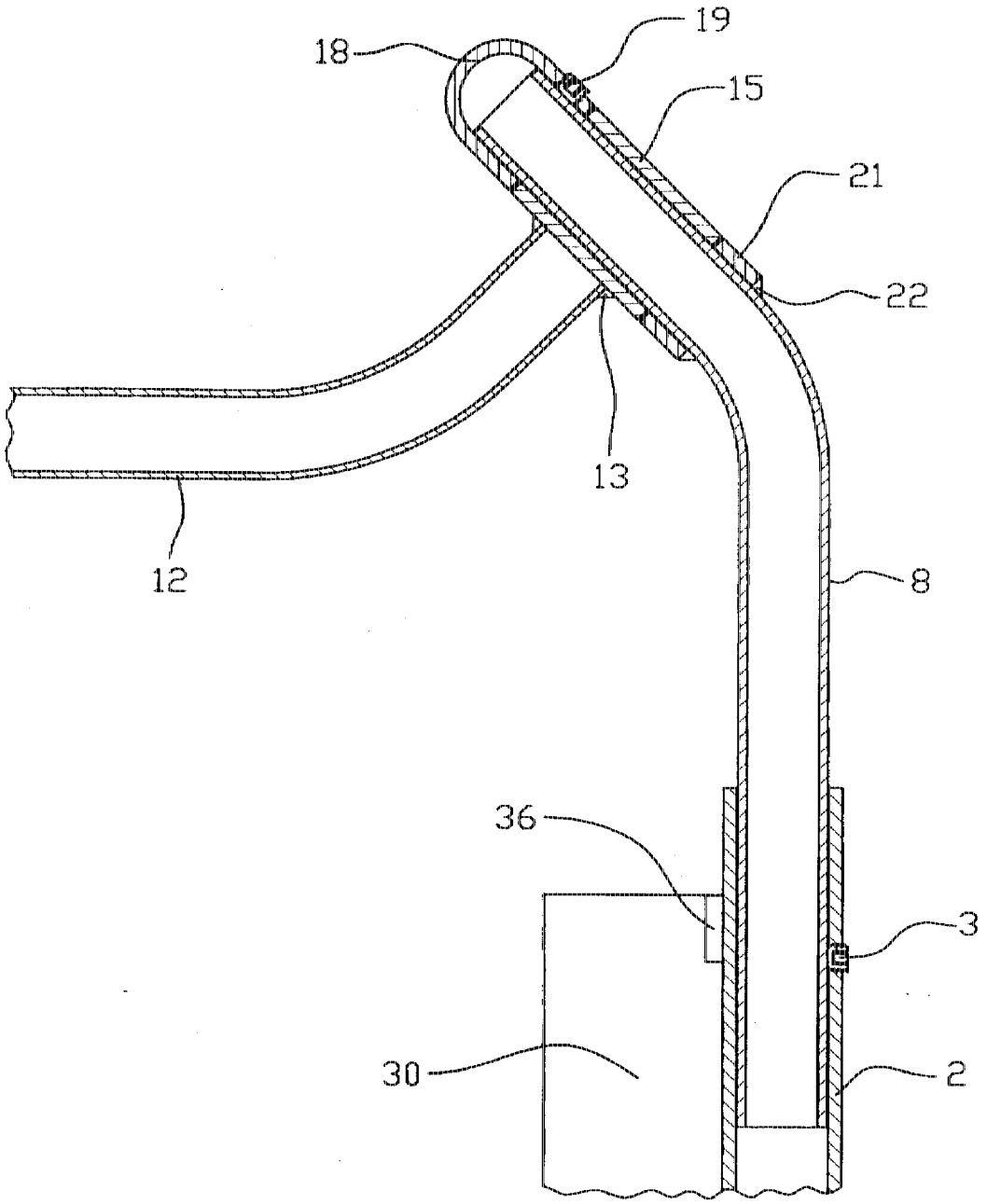
FIG. 2 is a partial cutaway view of the mailbox stand portraying the pivoting, rotating, and extension mechanisms.

Referring again to FIG. 1, a vertical extension shaft 8 having a circular cross section is mounted within the interior bore of the vertical support sleeve 2 in a manner allowing its vertical position to be fixed and allowing it to rotate about its vertical axis. Referring to FIG. 2, the vertical extension shaft 8 is made rotatable at a fixed vertical position by means of set screw 3. The overall height of the mailbox stand may be adjusted upward or downward by loosening the set screw 3, slidably positioning the vertical extension shaft 8, and retightening the set screw 3. Upon application of an extreme rotational force to the vertical extension shaft 8, said shaft will partially absorb said force by rotating about its vertical axis, sliding beneath the set screw 3.

Referring to FIG. 1, a mailbox support arm 12 is pivotally mounted at the upper end of the vertical extension shaft 8 by means of a cylindrical sleeve 15. Referring to FIG. 2, the upper end of the vertical extension shaft 8 is bent approximately 45° away from its vertical axis and a circular collar 21 is mounted over the vertical extension shaft 8 and fixed in place by means of a weld 22. With the circular collar 21 in place, the cylindrical sleeve 15 is slidably and rotatably placed over the vertical extension shaft 8. Slidable motion of the cylindrical sleeve 15 along the angled axis of the vertical extension shaft 8 and away from the circular collar 21 is restricted by an end cap 18 which is mounted over the upper end of the vertical extension shaft 8 and is fixed in place by means of a set screw 19. Alternately, a second circular collar may be used instead of an end cap, the second circular collar being fixed in place by means of a set screw. The mailbox support arm 12 is fixedly attached to the exterior sidewall of the cylindrical sleeve 15 by means of a weld 13. The mailbox support arm 12 extends outward perpendicularly, and thence is bent into a horizontal orientation. The section of the support arm 12 extending perpendicularly from the cylindrical sleeve 15 allows a mailbox attached to the opposite end of the support arm 12 to rotate upwardly away from the roadway to a position above and to the rear of the vertical extension shaft 8 with respect to the roadway.

Referring to FIG. 1, a pair of mailbox support brackets 24 are welded to the upper surface of the mailbox support arm 12, and a mailbox 27 is fixedly attached to the mailbox support brackets 24 by means of screws. Preferably, the mailbox 27 is constructed of impact resistant plastic or steel. The forward end of the mailbox support arm 12 is plugged with a cap 25, and a rectangular plate 30 bearing address identification numbers 33 is attached to the exterior sidewall of the vertical support sleeve 12 by means of welds 36.

In operation, a baseball bat, for example, is swung violently against the sidewall of the mailbox 27. Upon such contact, the assembly including the mailbox 27, the mailbox support brackets 24, the mailbox support arm 12, and the cylindrical sleeve 15, all rotate about the angled upper axis of the vertical extension shaft 8. Upon such rotation, such assembly rotates upward and away, partially absorbing the striking force. Additionally, referring to FIG. 2, upon application of such striking force, the vertical extension shaft 8 rotates about its lower vertical axis, sliding beneath the set screw 3, and allowing the mailbox assembly to rotate in a horizontal plane further absorbing the striking force. Finally, referring to FIG. 3, upon application of such a striking force, the threaded bolts 43 will break away allowing the upper portion of the mailbox stand to harmlessly topple to the ground. In operation, upon application of such a striking force, the combined impact absorbing effects of the rotation about the upper angled axis of the vertical extension shaft 8, the rotation about the lower vertical axis of the vertical extension shaft 8, and the breaking action of the threaded bolts 43 prevents the mailbox stand from suffering any damage other than to the bolts.

Upon application of a lesser force to the mailbox, it will simply swing away to a position vertically above the vertical extension shaft 8 and to the rear of the vertical extension shaft 8, reducing access to the mailbox for a second blow, and allowing the mailbox to later be pushed back to a horizontal position.

As described herein, the preferred embodiment for the mailbox stand in accordance with the present invention includes each of the features set forth above. It will be recognized, however, that any one or various combinations of the disclosed features may be used within a mailbox stand as desired, and that such will be within the scope of the present invention.

While the form of the apparatus herein described constitutes a preferred embodiment of this invention, it is to be understood that the invention is not limited to this precise form of apparatus, and that changes may be made therein without departing from the scope of the invention which is defined in the appended claims.

I claim:

1. A mailbox stand comprising:

(a) A mailbox support arm having a mailbox attachment end and having a pivotal attachment end, the pivotal attachment end of the mailbox support arm being bent at an acute angle away from the axial midline of the mailbox attachment end;

(b) A vertical extension and rotation shaft having a circular cross-section, having an upper support arm attachment end, and having a lower end, the support arm attachment end being bent at an acute angle away from the axial midline of the vertical extension and rotation shaft;

(c) A pivotal mounting means pivotally attaching the mailbox support arm to the support arm attachment end of the vertical extension and rotation shaft so that the pivotal attachment end of the mailbox support arm extends substantially perpendicularly from the support arm attachment end of the vertical extension and rotation shaft, and so that upon application of a striking force to a mailbox attached to the mailbox attachment end of the mailbox support arm, the mailbox may pivot around the support arm attachment end of the vertical extension and rotation shaft, wherein the pivotal mounting means comprises a first circular collar fixedly mounted over the support arm attachment end of the vertical extension and rotation shaft, a cylindrical sleeve rotatably mounted over the support arm attachment end of the vertical extension and rotation shaft and directly above the first circular collar, and a second circular collar fixedly mounted by means of a set screw over the support arm attachment end of the vertical extension and rotation shaft and directly above the cylindrical sleeve, said second circular collar being mounted to the support arm attachment end of the vertical extension and rotation shaft by a set screw extending through said second circular collar and contacting said support arm attachment end;

(d) A vertical support sleeve having a circular cross-section, having an upper end, and having a lower end, the upper end of the vertical support sleeve being fitted for slidably and rotatably receiving the lower end of the vertical extension and rotation shaft, the lower end of the vertical extension and rotation shaft being slidably and rotatably positioned within the upper end of the vertical support sleeve;

(e) A rotatable mounting means rotatably attaching the lower end of the vertical extension and rotation shaft to the upper end of the vertical support sleeve so that upon application of such a striking force to such mailbox, the vertical extension and rotation shaft may simultaneously rotate within the vertical support sleeve, wherein the rotatable mounting means comprises a threaded aperture within and through the sidewall of the vertical support sleeve, the threaded aperture being positioned thereon to overlie the vertical extension and rotation shaft, and a set screw threadedly mounted within the threaded aperture;

(f) An upper breakaway plate, having an upper surface, having a lower surface, and having a plurality of upper bolt receiving apertures extending from its upper surface to its lower surface, the upper surface of the upper breakaway plate being fixedly attached to the lower end of the vertical support sleeve;

(g) A lower breakaway plate, having an upper surface, having a lower surface, and having a plurality of lower bolt receiving apertures, the lower bolt receiving apertures extending from the upper surface of the lower breakaway plate to its lower surface, the lower bolt receiving apertures being positioned upon the lower breakaway plate so that they may be aligned with the upper bolt receiving apertures of the upper breakaway plate, the upper surface of the lower breakaway plate being in contact with the lower surface of the upper breakaway plate, and positioned so that the lower bolt receiving apertures are aligned with the upper bolt receiving apertures;

(h) A breakaway plate support shaft having an upper end and a lower end, the upper end being fixedly attached to the lower surface of the lower breakaway plate, the breakaway plate support shaft extending downward from the lower surface of the lower breakaway plate; and, (i) A plurality of bolt fasteners, the bolt fasteners passing through the upper and lower bolt receiving apertures of the upper and lower breakaway plates, fixedly attaching the upper breakaway plate to the lower breakaway plate, the bolt fasteners being of a gauge and being composed of a material so that upon application of such a striking force to such a mailbox the bolt fasteners may simultaneously fracture, allowing the mailbox stand to fall to the ground.

2. The mailbox stand of claim No. 1, wherein the upper and the lower breakaway plates are triangular in shape, and wherein the plurality of upper and lower bolt receiving apertures are positioned in a triangular configuration, the sides of the triangular configuration of upper and lower bolt receiving apertures being aligned with the sides of the breakaway plates.

3. The mailbox stand of claim No. 2, further comprising a mailbox attachment bracket fixedly attached to the upper surface of the mailbox attachment end of the mailbox support arm, the mailbox attachment bracket being adapted for retaining and supporting a common rural route mailbox.

* * * * *